United States Patent [19]

Espenscheid et al.

[11] 4,035,287

[45] July 12, 1977

[54] DESULFURIZATION OF RESIDUAL OIL

[75] Inventors: Wilton F. Espenscheid, Princeton; Tsoung-Yuan Yan, Trenton, both of N.J.

[73] Assignee: Mobil Oil Corporation, New York, N.Y.

[21] Appl. No.: 607,159

[22] Filed: Aug. 25, 1975

[51] Int. Cl.[2] ..... C10G 21/10

[52] U.S. Cl. ..... 208/242; 208/25 R; 208/338

[58] Field of Search ..... 208/251 R, 208, 309, 208/338, 242

[56] References Cited

U.S. PATENT DOCUMENTS

| | | | |
|---|---|---|---|
| 2,646,390 | 7/1953 | Arnold et al. | 208/338 |
| 2,866,689 | 12/1958 | Samuels | 208/338 |
| 2,943,050 | 6/1960 | Beavon | 208/309 |
| 3,294,678 | 12/1966 | Gleim | 208/309 |
| 3,511,774 | 5/1970 | Long et al. | 208/309 |

*Primary Examiner*—Herbert Levine
*Attorney, Agent, or Firm*—Charles A. Huggett; Raymond W. Barclay; Dennis P. Santini

[57] ABSTRACT

A method is provided for desulfurization of oil stock, e.g. residual oil, having a minimum sulfur content of about 2 weight percent and a minimum metals content of about 50 ppm to produce a low-sulfur, high-metals content raffinate and a high-sulfur, low-metals content extract which comprises contacting said oil stock with a solvent selective for low molecular weight aromatics and having a boiling point within the range of from about 0° F to about 100° F and a density greater than or less than the density of the oil stock being contacted by at least 0.1 g/cc, said contacting being conducted at a temperature of from about 60° F to about 212° F, a solvent/oil stock volume ratio of from about 0.25 to about 10 and a pressure higher than the vapor pressure of the solvent at the contacting temperature, and separating the low-sulfur, high-metals content raffinate from the high-sulfur, low-metals content extract.

12 Claims, No Drawings

DESULFURIZATION OF RESIDUAL OIL

BACKGROUND OF THE INVENTION

1. Field of the Invention

This invention relates to a new and improved method for desulfurization of oil stock, e.g. residual oil. More particularly, it relates to a solvent extraction method for preparing a low-sulfur, high-metals content raffinate and a high-sulfur, low-metals content extract from residual oil.

2. Description of Prior Art

It has been proposed to improve the salability of high sulfur and metal content residual-containing petroleum oils by a variety of hydroprocessing methods, e.g. hydrodesulfurization and hydrodemetalation. However, difficulty has been experienced in achieving a commercially feasible catalytic hydroprocessing process. Short catalyst life in such processes is manifested by inability of a catalyst to maintain a relatively high capability for desulfurizing charge stock with increasing quantities of coke and/or metallic contaminants deposited thereon which act as catalyst poisons. Satisfactory catalyst life can be obtained relatively easily with distillate oils, but is especially difficult to obtain in desulfurizing residual oils, since the asphaltenic or porphyrinic components of an oil, which tend to form disproportionate amounts of coke, are concentrated in the residual fractions of a petroleum oil, and since a relatively high proportion of the metallic contaminants that normally tend to poison catalysts are commonly found in the asphaltene components of the oil. Further, on a commercial scale, these processes are rather costly due to high hydrogen consumption levels. It is, therefore, advantageous to provide a desulfurization process such as the present invention which exhibits superior characteristics including good desulfurization benefits and no hydrogen consumption.

U.S. Pat. Nos. 3,716,479 and 3,772,185 propose demetalation of a hydrocarbon charge stock by contacting the charge stock with added hydrogen in the presence of a catalyst material derived from a manganese nodule.

British Pat. Nos. 1,318,941 and 1,318,942 teach use of zinc, magnesium, beryllium or calcium aluminate spinels combined, after calcination, with a Group VIII metal, such as, for example, platinum, as a dehydrogenation catalyst.

Demetalation of hydrocarbon fractions is taught in U.S. Pat. No. 2,902,429 as contacting said fractions with a catalyst having a relatively small amount of a sulfur-resistant hydrogenation-dehydrogenation component disposed on a low surface area carrier, i.e., a carrier with a surface area of not more than $15m^2/g$, and preferably not more than about $3m^2/g$. Examples of such low surface area carriers include diatomaceous earth, natural clays and Alundum.

Methods for separation of aromatics from paraffins or naphthenes are known in the art. See, for example, U.S. Pat. Nos. 2,109,157; 2,724,682; 2,758,141; and 3,222,416. However, the present invention is a method for separation of sulfur-containing components from the metal-containing components in a residual oil by extraction even though both types of components are generally aromatic in nature.

There are numerous references in the art showing various metals combined with carriers such as alumina, silica, zirconia or titania as catalysts for use in demetalation and/or desulfurization processes. No references are known to the applicants which teach the present invention with its attendant benefits.

SUMMARY OF THE INVENTION

In accordance with the present invention, an oil stock, e.g. residual oil, having a minimum sulfur content of about 2 weight percent and a minimum metals content of about 50 ppm is desulfurized by contacting it with a solvent selective for low molecular weight aromatics and having a boiling point of from about 0° F to about 100° F and a density greater than or less than the density of said oil stock by at least 0.1 g/cc, thereby forming a low-sulfur, high-metals content raffinate and a high-sulfur; low-metals content extract, and then separating said raffinate from said extract. The contacting step is conducted at a temperature of from about 60° F to about 212° F, a solvent/oil stock, e.g. residual oil, volume ratio of from about 0.25 to about 10 and a pressure higher than the vapor pressure of the solvent at the contacting temperature.

DESCRIPTION OF PREFERRED EMBODIMENTS

The oil stock which may be treated in accordance with this invention may generally be any residual oil comprising a total metals content, e.g. nickel and vanadium, of greater than about 50 ppm with a maximum metals content of about 150 ppm, or, more usually, between about 50 ppm and about 100 ppm, and a sulfur content of at least about 2 weight percent. Said oil stock may also be found to be a high boiling range residual oil boiling above about 600° F. Such oil stock may include components obtained by, for example, fractionation, such as atmospheric or vacuum crude distillation, of crude oils. Non-limiting examples of said crude oils are Pennsylvania, midcontinent, Gulf Coast, West Texas, Amal, Agha Jari, Kuwait, Barco, Arabian and others. Said oil stock may be one having a substantial portion thereof of the fractionation product of one or more of the above-mentioned crude oils mixed with other oil stocks.

It is further observed that the present process may be effectively utilized for crude oil desulfurization when said crude oil comprises a total metals content of between about 50 ppm and about 75 ppm and a sulfur content of at least about 2 weight percent. Also, the oil stock to be treated in accordance herewith may be comprised of a portion of an above-defined crude oil with a portion of an above-defined residual oil.

Since sulfur compounds in the oil stocks to be treated in accordance herewith are generally aromatic in nature (i.e., thiophene derivatives) or are associated with aromatics (i.e., benzothiophenes, etc.), the chemical nature of the sulfur atoms is typically overpowered by the aromatic constituents of the molecules. Therefore, the solvent material for use herein must be selective for aromatics and must have a density greater than or less than the density of the oil stock being contacted therewith by at least 0.1 g/cc.

Such a solvent would reject saturates, the most desirable components in residual fuels, and thereby allow them to remain in the raffinate phase product of the process.

It is noted also that the metal complexes (i.e., porophenes) and asphaltenes associated with the oil stock for treatment herewith are aromatic in nature. Also, the porophenes and asphaltenes are typically high in molecular weight, e.g., higher than about 1000. On the other hand, sulfur components of the oil stock are uniformly distributed in the entire boiling range of the oil stock, with a small maximum around 800°–900° F. Therefore, the solvent material for use herein must be selective for aromatics having a relatively low molecular weight of from about 280 to about 600.

A further requirement of the solvent for use in this process is that it has a relatively low boiling point of from about 0° F to about 100° F to facilitate separation from the extract phase of the process.

A solvent meeting all the above requirements is liquid sulfur dioxide.

Solvents such as sulfolane, ethylene carbonate, propylene carbonate and gamma-butyrolactone may seem, at first glance, to be suitable for the present process. However, due to their high boiling nature, they prove to be much less economically suitable than solvents having all the above-described properties.

One of the marked advantages of the present process is the fact that the extract phase product is high in sulfur content and low in metals content, thus rendering it an ideal feedstock for known hydrodesulfurization proceses. When one of the other solvents listed above and not conforming to the requirements established for the solvent of the present process, e.g. sulfolane, is used, the extract phase contains higher metals content (i.e., vanadium is extracted from the oil stock being treated along with sulfur) and is therefore not as advantageously useful in hydrodesulfurization processing.

The operating parameters in the present process are critical to achieving the desired results of degrees of desulfurization of the oil stock being treated hereby without substantial loss in yield. For example, the temperature of the present process must be within the range of from about 60° F to about 212° F, with a preferred temperature range of from about 70° F to about 120° F. The pressure of the reaction system of the present process must be higher than the vapor pressure of the solvent at the contacting temperature. The solvent/oil stock volume ratio must be from about 0.25 to about 10, with a preferred range of from about 0.5 to about 3.

It is an advantage of the present process that the raffinate therefrom, being high in metals content but low in sulfur content, may be used as residual fuel without further processing. In fact, the high metals content, e.g. vanadium, may enhance combustion of the residual oil in current burner systems. Also, the extract from the present process, being low in metals content and high in sulfur content, may be used as aromatic oil for carbon black production without further processing. Further, said extract phase from the present process may be easily desulfurized in conventional ways to produce low-sulfur heating oil.

Separation of the extract and raffinate phases created in the contacting step of the present process may be accomplished by one of several suitable methods known in the art. Non-limiting examples of such separation methods include settling, decantation, cyclonization, centrifugation and coalescence.

In order to more fully illustrate the process of the present invention, the following specific examples, which in no sense limit the invention, are presented.

EXAMPLE 1

An Agha Jari 650+° F residual oil was contacted with liquid $SO_2$ solvent at a 1.2/1 solvent/oil volume ratio, a temperature of 75° F and a pressure of 45 psig. The $SO_2$- rich bottom layer was removed in several cuts to insure positive identification of the cut point, and each cut (where sufficient quantity of material was available) was analyzed for sulfur, nickel, and vanadium after the liquid sulfur dioxide was flashed off at 110° C under 25 inches of vacuum. Table I shows the analysis of the feed along with seven cuts taken on the $SO_2$/oil mixture. The sulfur analysis shows that cuts 3 and 4 (extract) were slightly contaminated with raffinate. Columns 9 and 10 of Table I show the analysis on combined cuts 1–3, and cuts 1–4, respectively. The last two columns were calculated as if cuts 3 and 4 were linear combinations of cut 1 and cut 6. These data show that nickel is uniformly distributed in both phases, and that vanadium is slightly enriched in the extract. However, the extract becomes highly enriched in sulfur. Conradson carbon (CCR) was run on the feed and on cut 6 of the $SO_2$ extraction, which represents the raffinate.

TABLE I

Example 1: Contact of 650+ ° F Residual Oil with Liquid $SO_2$

| | Feed | Cut No. 1 | Cut No. 2 | Cut No. 3 | Cut No. 4 | Cut No. 5 | Cut No. 6 | Cut No. 7 |
|---|---|---|---|---|---|---|---|---|
| Wt. % of Feedstock | 100 | 2.66 | 1.81 | 7.27 | 14.56 | 27.04 | 45.33 | 1.29 |
| S, wt. % | 2.08 | 4.32 | 4.46 | 3.01 | 2.55 | 1.93 | 1.90 | — |
| Ni, ppm | 15 | — | — | — | 15 | 15 | 15 | — |
| V, ppm | 50 | — | — | — | 42 | 42 | 42 | — |
| S/Ni, wt./wt. × $10^{-2}$ | 13.9 | — | — | — | 17 | 12.8 | 12.6 | — |
| S/V, wt./wt. × $10^{-2}$ | 4.2 | — | — | — | 6.1 | 4.6 | 4.5 | — |
| CCR | 5.09 | | | | | | 5.04 | |

| | Combined 1–3 | Combined 1–4 | Calculated* Extract | Calculated* Raffinate |
|---|---|---|---|---|
| Wt. % of Feedstock | 11.75 | 14.56 | 11.84 | 88.12 |
| S, wt. % | 3.53 | 2.55 | 4.39 | 1.90 |
| Ni, ppm | 22 | 15 | 15 | 15 |
| V, ppm | 78 | 42 | 110 | 42 |
| S/Ni, wt./wt. × $10^{-2}$ | 16 | 17 | 29.3 | 12.6 |
| S/V, wt./wt. × $10^{-2}$ | 4.5 | 6.1 | 4.0 | 4.5 |
| $\frac{\text{S/Ni (Extract)}}{\text{S/Ni (Raffinate)}}$ | | 1.30 | 2.3 | |
| $\frac{\text{S/V (Extract)}}{\text{S/V (Raffinate)}}$ | | 1.12 | .9 | |

*Assuming that cuts 3, 4 and 5 are linear combinations of cuts 1 and 6.

EXAMPLE 2

An Agha Jari 650+° F residual oil was contacted with liquid $SO_2$ solvent and benzene (solvent/benzene volume ratio = 9/l) at a solvent/oil volume ratio of 1.2/l, a temperature of 75° F and a pressure of 45 psig. The cutting procedure of Example 1 was followed with the results appearing in Table II.

TABLE II

Example 2: Contact of 650+ ° F Residual Oil with Liquid $SO_2$ and benzene

| | Feed | Cut No. 1 | Cut No. 2 | Cut No. 3 | Cut No. 4 | Cut No. 5 | Cut No. 6 | Cut No. 7 | Combined 1–5 | Calculated* Extract | Calculated* Raffinate |
|---|---|---|---|---|---|---|---|---|---|---|---|
| Wt. % of Feedstock | 100 | 2.28 | 3.32 | 2.36 | 2.58 | 7.04 | 2.14 | 80.37 | 16.58 | 18.9 | 81.1 |
| S, wt. % | 2.08 | 3.80 | 3.80 | 3.83 | 3.88 | 3.87 | 3.03 | 1.77 | 3.84 | 3.84 | 1.77 |
| Ni, ppm | 15 | — | — | — | — | — | — | 14. | 23 | 23 | 14. |
| V, ppm | 50 | — | — | — | — | — | — | 41. | 86 | 86 | 41 |
| S/Ni, wt./wt. × $10^{-2}$ | 13.9 | — | — | — | — | — | — | 12.7 | 16.7 | 16.7 | 12.7 |
| S/V, wt./wt. × $10^{-2}$ | 4.2 | — | — | — | — | — | — | 4.3 | 4.5 | 4.5 | 4.3 |
| $\frac{\text{S/Ni (Extract)}}{\text{S/Ni (Raffinate)}}$ | | | | | | | | | 1.32 | 1.32 | |
| $\frac{\text{S/V (Extract)}}{\text{S/V (Raffinate)}}$ | | | | | | | | | 1.03 | 1.03 | |

*Assuming that cut 6 is a linear combination of cuts 1–5 and cut 7

In order to establish the criticality of the solvent requirements for the present process, sulfolane, ethylene carbonate, propylene carbonate and gamma-butyrolactone were used as the solvent in the present process. Results were less than satisfactory as exemplified below.

EXAMPLE 3

Equal weights of solvent and Agha Jari 650+° F residual oil were brought to 203° F, shaken every half hour for two hours, and allowed to stand at this temperature overnight in separatory funnels. The contacting was conducted at atmospheric pressure. The extract phase was drawn off and weighed. Elemental analysis of each layer (with warming and shaking before sampling) gives directly the S/Ni and S/V ratios in each phase.

More difficult to obtain was the amount of solvent in the raffinate, and resid in the solvent layer. This was performed in three ways:

1. Vapor chromatography with internal standard. A mutual solvent, benzene, was mixed with each extractive solvent and the VPC response factor determined. A known weight of benzene was added to the extract and raffinate phases, and the amount of solvent in the raffinate, and resid in the extract, were determined.
2. Resid in the extract was determined by optical density using known mixtures that obey Beer's Law.
3. For sulfolane (a sulfur-containing solvent), the solvent was extracted five times with large excesses of water, and dried at 110° C under vacuum. The agreement between the methods is reasonable, although not as good as the sulfur/metal ratios themselves.

Results appear in Table III.

TABLE III

Contacting Residual Oil with Various Solvents

| Solvent | Boiling Point °F | $d_4^{20}$ | Solvent Layer[a] % S | Solvent Layer[a] Ni (ppm) | Solvent Layer[a] V (ppm) | Resid Layer[a] % S | Resid Layer[a] Ni (ppm) | Resid Layer[a] V (ppm) | Enrichment[b] S/Ni | Enrichment[b] S/V |
|---|---|---|---|---|---|---|---|---|---|---|
| Sulfolane | 550 | 1.26 | 3.43 | 20 | 157 | 1.92 | 16 | 58 | 1.52 | 0.6 |
| Ethylene Carbonate | 543 | 1.32 | 2.67 | 13 | 166 | 2.17 | 15 | 66 | 1.42 | 0.5 |
| Propylene Carbonate | 435 | 1.21 | 2.77 | 13 | 139 | 2.06 | 15 | 60 | 1.69 | 0.6 |
| γ-Butyrolactone | | | 3.26 | 21 | 505 | 1.83 | 14 | 56 | 1.15 | 0.6 |
| Feed | 650+ | ≈1 | 2.08 | 15 | 50 | | | | | |
| Sulfur Dioxide | 14 | 1.45 | 4.4 | 15 | 110 | 1.9 | 15 | | 2.3 | 0.9 |

[a]Solvent-free Basis

[b] $\frac{\text{S/Metal (Extract)}}{\text{S/Metal (Raffinate)}}$

A commercial method of reducing the sulfur content of a residual oil is by extraction with paraffinic solvents such as propane/butane in a propane deasphalting unit. In such a method, the extract phase is paraffinic in nature, low in sulfur, and can be used as low-sulfur residual fuel. The great quantity of raffinate from such a process (50–60% of the feed) is enriched with sulfur, metals and carbon residue and is beyond the capability of present technology for hydrodesulfurization. The following example substantiates the above contentions.

EXAMPLE 4

A residual oil from a West Texas sour crude was contacted with propane/butane solvent in a propane deasphalting unit at 135° F (ave. temperature), 300 psig. and a solvent/oil volume ratio of 7. The extract phase was lower in metals and sulfur than the residual oil feedstock. The raffinate phase (58.4% of the feed) was enriched in both sulfur and metals and had a high Conradson Carbon number (CCR). The results of this example are summarized in Table IV.

TABLE IV

Residual Oil Contacted with Propane/Butane Solvent

| | Feed | Extract | Raffinate |
|---|---|---|---|
| Metals, ppm | | | |
| Ni | 24 | .41 | 41 |
| V | 25 | .34 | 63 |
| Sulfur, % | 3.47 | 2.47 | 5.14 |
| CCR | 17.1 | 1.6 | 27.2 |
| Yield, Vol. % | | | |
| Deasphalted | 100 | 41.6 | 58.4 |

TABLE IV-continued

| Residual Oil Contacted with Propane/Butane Solvent | | | |
|---|---|---|---|
| | Feed | Extract | Raffinate |
| Crude | 17.9 | 7.4 | 10.5 |

We claim:

1. A method for desulfurization of an oil stock having a minimum sulfur content of about 2 weight percent and a minimum metals content of about 50 ppm to produce a low-sulfur, high-metals content raffinate and a high-sulfur, low-metals content extract which comprises contacting said oil stock with liquid sulfur dioxide solvent at a temperature of from about 60° F to about 212° F, a solvent/oil stock volume ratio of from about 0.25 to about 10 and a pressure higher than the vapor pressure of the solvent at the contacting temperature, and separating the low-sulfur, high-metals content raffinate from the high-sulfur, low-metals content extract.

2. The method of claim 1 wherein the contacting is conducted at a temperature of from about 70° F to about 120° F and a solvent/oil stock volume ratio of from about 0.5 to about 3.

3. The method of claim 1 wherein said oil stock is a residual oil having a total metals content of from about 50 ppm to about 150 ppm.

4. The method of claim 3 wherein said metals content is from about 50 ppm to about 100 ppm.

5. The method of claim 3 wherein the contacting is conducted at a temperature of from about 70° F to about 120° F and a solvent/oil stock volume ratio of from about 0.5 to about 3.

6. The method of claim 4 wherein the contacting is conducted at a temperature of from about 70° F to about 120° F and a solvent/oil stock volume ratio of from about 0.5 to about 3.

7. The method of claim 1 wherein said oil stock is a high boiling range residual oil boiling above about 600° F.

8. The method of claim 7 wherein the contacting is conducted at a temperature of from about 70° F to about 120° F and a solvent/oil stock volume ratio of from about 0.5 to about 3.

9. The method of claim 1 wherein said oil stock comprises at least a substantial part of one obtained by fractionation of a crude oil identified as Pennsylvania, Midcontinent, Gulf Coast, West Texas, Amal, Agha Jari, Kuwait, Barco or Arabian.

10. The method of claim 9 wherein the contacting is conducted at a temperature of from about 70° F to about 120° F and a solvent/oil stock volume ratio of from about 0.5 to about 3.

11. The method of claim 1 wherein said oil stock is one obtained by fractionation of crude oil identified as Agha Jari.

12. The method of claim 11 wherein the contacting is conducted at a temperature of from about 70° F to about 120° F and a solvent/oil stock volume ratio of from about 0.5 to about 3.

* * * * *